United States Patent [19]

Kishimoto

[11] Patent Number: 4,698,488

[45] Date of Patent: Oct. 6, 1987

[54] FLEXIBLE THERMOSENSITIVE WIRE

[75] Inventor: Yoshio Kishimoto, Hirakata, Japan

[73] Assignee: Matsushita Electric Industrial Co., Ltd., Osaka, Japan

[21] Appl. No.: 723,627

[22] Filed: Apr. 15, 1985

[51] Int. Cl.[4] ..... H05B 3/34

[52] U.S. Cl. ..... 219/549; 219/548; 219/546

[58] Field of Search ..... 219/549, 548, 546; 526/87, 255; 522/112, 156

[56] References Cited

U.S. PATENT DOCUMENTS

| | | | |
|---|---|---|---|
| 2,941,176 | 6/1960 | Jacoby | 338/262 X |
| 3,933,773 | 1/1976 | Foerster | 522/112 X |
| 4,271,350 | 6/1981 | Crowley | 219/549 |
| 4,547,658 | 10/1985 | Crowley | 219/549 X |

*Primary Examiner*—E. A. Goldberg
*Assistant Examiner*—M. M. Lateef
*Attorney, Agent, or Firm*—Spencer & Frank

[57] ABSTRACT

A flexible thermosensitive wire used for electric heating fabrics, such as electric blankets, electric carpets etc., which wire is protected against damage from dry cleaning solvents to allow safe dry cleaning of the electric heating fabrics. The flexible thermosensitive wire includes a thermosensitive polymer composition layer formed between at least one pair of electrodes and is covered with a jacket, wherein at least part of the jacket is composed of a barrier polymer material which is resistant to dry cleaning solvents.

11 Claims, 4 Drawing Figures

FLEXIBLE THERMOSENSITIVE WIRE

BACKGROUND OF THE INVENTION

1. Field of the Invention

The present invention relates to a flexible thermosensitive wire used for electric heating fabrics, such as for electric blankets, electric carpet and the like.

2. Discussion of the Art

No effective means were available for removing soil or stains from conventional electric heating fabrics, such as electric blankets, and especially when electric parts are embedded in the body of such an electric blanket, it was even impossible to wash the whole or part of the blanket. Washing of such electric heating fabrics has been made possible by incorporating measures for preventing corrosion of connecting pins or tacking between terminals. However, bulky fabrics, such as a blanket, are not easy to wash at home, and so it would be most desirable if such electric heating fabrics could be dry cleaned by a laundry. Dry cleaning of conventional electric blankets, however, has involved some serious problems as follows:

(1) Since the electrical insulating jacket of flexible thermosensitive wire used for heaters or temperature sensors is usually composed of a plasticized polyvinyl chloride composition, the plasticizer contained in such plasticized polyvinyl chloride compositions might be dissolved out by the action of the dry cleaning solvent, such as petroleum hydrocarbon solvent (for example naphtha) or halogenated hydrocarbon solvent [for example perchlene(tetrachloroethylene)], resulting in reduced flexibility and thickness of the electrical insulating jacket.

(2) If said wire jacket is further deteriorated and the dry cleaning solvent is brought into contact with the thermosensitive polymer composition layer in said jacket, the electrical properties of the layer are caused to change greatly.

SUMMARY OF THE INVENTION

The present invention relates to a flexible thermosensitive wire used for electric heating fabrics, such as electric blankets, electric carpets and the like, which wire is protected against damage from dry cleaning to allow safe dry cleaning of such electric heating fabrics.

The flexible thermosensitive wire of the present invention is characterized in that it has a thermosensitive polymer composition layer formed between at least one pair of electrodes and is covered with a jacket, wherein at least part of said jacket is composed of a barrier resin which is resistant to dry cleaning solvents.

BRIEF DESCRIPTION OF THE DRAWING

In the drawings, like characters of reference designate like parts throughout the views, in which the respective reference characters designate the following parts or elements.

Figure 1:
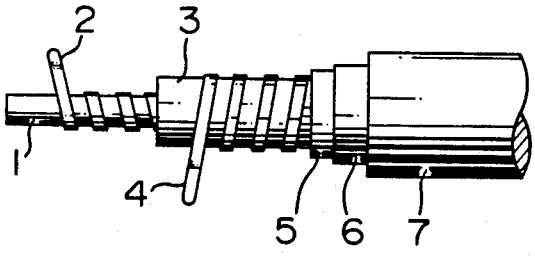
FIG. 1 is a side view of a first embodiment of flexible thermosensitive wire according to the present invention, the wire being shown partly cut away stepwise to clarify the wire structure.

1, 1': flexible core yarn,
2: inside electrode;
3: thermosensitive polymer composition layer;
4: outside electrode;
5: inside barrier layer of polymer composition;
6: outside barrier layer of polymer composition;
7: insoluble outer jacket;
8: outer jacket;
10: electrode;
13: thermosensitive polymer composition layer which functions as a PTC resistance layer;
14: electrode;
15: barrier layer.

DETAILED DESCRIPTION OF THE PREFERRED EMBODIMENTS

The present invention provides a flexible thermosensitive wire having a thermosensitive polymer composition layer formed between at least a pair of electrodes and being coated with an outer jacket, at least part of said outer jacket providing a barrier action against dry cleaning solvent. This barrier serves to ward off the influence of dry cleaning solvent on electrical and mechanical functions of the flexible thermosensitive wire. A barrier is formed by constituting at least part of the outer jacket of a high polymer material having barrier properties against dry cleaning solvents such as petroleum hydrocarbons, for example naphtha, or halogenated hydrocarbons.

Thus, the flexible thermosensitive wire of the present invention is protected in its inside structure by said barrier of polymer material resistant to petroleum or halogenated hydrocarbons and is therefore rendered safe from dry cleaning. The term "thermosensitive polymeric composition layer" used in this specification refers to a layer which functions as a temperature fuse layer, polymer a thermistor layer, resistance layer having a large positive temperature coefficient of resistance (hereinafter referred to as a PTC resistance layer) and the like. A temperature fuse layer is composed of a crystalline thermoplastic resin, such as 12 nylon, and a polymer thermistor layer is composed of a thermosensitive polymer capacitor material or polymer semiconductor material based on polyvinyl chloride or nylon, which is capable of reducing impedance upon a rise in temperature. A PTC resistance layer is made of a composite composition prepared by dispersing electroconductive particles, such as carbon black, in a crystalline polymer matrix.

Usually, halogenated hydrocarbons, such as trichloroethylene, tetrachloroethylene, trichloroethane, etc., or petroleum hydrocarbons, such as naphtha, are used as dry cleaning solvents.

As for the polymer material used for forming a barrier against said petroleum or halogenated hydrocarbon solvents, generally the materials having hydrogen bonds or highly crystalline materials having excellent resistance to and non-affinity for said types of solvent are found able to serve for the purpose. Typical examples of such materials are (1) fluorine-containing polymers, such as polyvinyl fluoride and polyvinylidene fluoride,
(2) acrylonitrile copolymers, such as acrylonitrile-butadiene rubber (NBR),
(3) polyamides such as 11 nylon and 12 nylon,
(4) vinyl alcohol copolymers, such as a partially saponified ethylene-vinyl alcohol copolymer and ethylene-vinyl acetate copolymer,
(5) metal chelate-containing polymer, such as Ionomers, and metal salts of ethylenemaleic acid, and
(6) highly crystalline polyolefins, such as high-density polyethylene and polypropylene.

These polymers or compositions based on such polymers are suited for use as the barrier-forming polymeric material in the present invention.

In case said outer jacket has a multi-layered structure, at least one layer thereof is constituted as a barrier layer. In this case, it is desirable that said polymer material having barrier properties is used for forming the inside layer while the other layer (or layers) is made of an inexpensive, flexible and elastomeric composition which is insoluble in dry cleaning solvents, and is, for example, a vinyl chloride soft copolymer of a vinyl chloride polymer blend. Ethylene-vinyl chloride copolymers and ethylene-vinyl acetate-vinyl chloride copolymers may be mentioned as preferred examples of said vinyl chloride soft copolymer. As said vinyl chloride polymer blend, there can be used, for instance, an acrylonitrile-butadiene rubber (NBR) and a polyvinyl chloride (PVC) blend, a chlorinated polyethylene and a PVC blend, and an ethylene-vinyl acetate copolymer and a PVC blend.

The flexible thermosensitive wire of the present invention can be utilized as a flexible temperature sensor by using the incorporated electrodes as signal detection lines, and it can serve as a thermosensitive heater by arranging at least one of the electrodes to function as a heating wire.

The characteristic structure of the present invention will be further described below by way of the embodiments thereof.

EXAMPLE 1

Referring to FIG. 1, there is shown a side view, with parts cut away, of a first embodiment of flexible thermosensitive wire according to the present invention. The embodiment consists of a flexible core yarn 1, an inside electrode 2, a thermosensitive polymer composition layer 3, an outside electrode 4, an inside layer of polymer barrier material 5, an outside layer of polymer barrier material 6, and an insoluble outer jacket 7. As is seen, these elements are provided in this order from the inside to the outside. It will be also noted that a jacket having a multilayered structure is constituted of said inside and outside polymer barrier layers 5, 6 and said insoluble outer jacket 7.

The structure is described more concretely as follows. A stainless foil of 0.32 mm width and 0.05 mm in thickness was coiled at a pitch of 0.7 mm on a flexible core yarn 1 of 2,000-denier polyester as shown in FIG. 1 to form an inside electrode 2. This was tubed by a 0.28 mm thick layer of an ion-conductive, thermosensitive polymer composition 3 using an organic perchlorate as carrier. On this layer 3 was further coiled a stainless foil to form an outside electrode 4. This inside structure was coated with 12 nylon ("Diamide" manufactured by Dicel Chemical Ind. Co., Ltd.) and a vinyl alcohol copolymer ("Eval" manufactured by Kurarey Co., Ltd.), successively, in that order to form an inside polymer barrier layer 5 and an outside polymer barrier layer 6, both being about 0.1 mm in thickness. This was further covered with an ethylene-vinyl chloride copolymer to a thickness of 0.4 mm to form an insoluble outer jacket 7. The thus obtained flexible thermosensitive wire was immersed in perchloroethylene (ethylene tetrachloride), which is an example of a dry cleaning solvent, for about 24 hours, and after air drying for 24 hours and further drying at 80° C. for 24 hours, the impedance-temperature characteristic of said wire was measured. As seen from FIG. 2, which shows the results of measurement, the wire of Example 1 of this invention had a very small in change of said characteristic (curves $A_1$and $A_2$) in comparison with a conventional product B (curve B).

Figure 2:
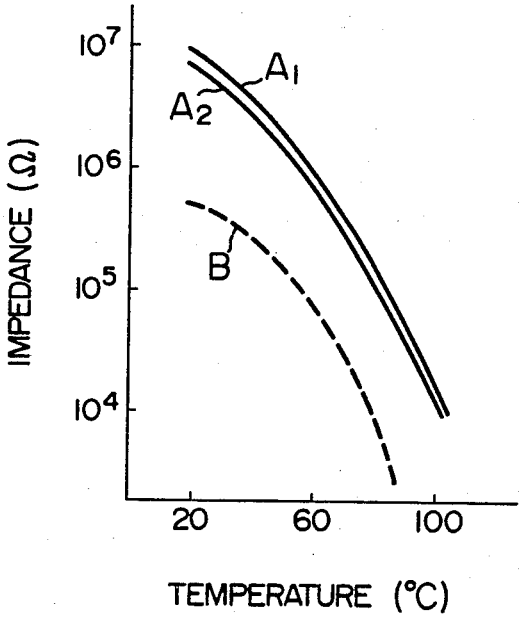
FIG. 2 is an impedance-temperature characteristic curve of the flexible thermosensitive wire of the present invention shown in FIG. 1 ($A_1$, $A_2$) and a conventional flexible thermosensitive wire (B).

Shown in FIG. 2 are the impedance-temperature characteristic curves measured for a 1 meter wire length at 60 Hz. Curve B is that of a conventional product measured after immersion. A1 and A2 are the characteristic curves obtained for the product of the described embodiment of this Example 1, A1 representing the test result before immersion and A2 representing the result after immersion.

EXAMPLE 2

Described here is a variation of the first embodiment of this invention having the same structure as shown in FIG. 1.

On a 2,000-denier polyester core yarn 1 was inwardly coiled a copper wire (width: 0.38 mm, thickness: 0.07 mm, pitch: 0.8 mm) to form an inside electrode 2. This was followed by tubing with a temperature fuse layer 3 (12 nylon, 0.26 mm thick), outward coiling thereon of a copper wire (0.38 mm wide and 0.07 mm thick, at a pitch of 1.8 mm) to form an outside electrode 4, and coating with the same polymeric barrier layer 5 is used in Example 1 to constitute a flexible thermosensitive wire.

This flexible thermosensitive wire was immersed in a petroleum hydrocarbon dry cleaning solvent ("Disol" by Daikyo Oil Co., Ltd.) for 24 hours, and after air drying for 24 hours and further drying at 80° C. for additional 24 hours, the heater temperature was raised from 150° C. at a rate of 1° C./min to determine the fusing temperature of the temperature fuse. The fuse went out (fused) when the heater temperature reached about 178° C. On the other hand, a plasticized vinyl chloride-clad heater of a conventional structure lost flexibility after said immersion and drying, and when it was subjected to the same test for determining the fusing temperature of the temperature fuse as described above, it showed an unstable fusing behavior, the fuse being fused at a higher heater temperature of from 198° to 230° C., and a wide scatter was seen in fusing characteristic.

EXAMPLE 3

Described here is a still further variation of the first embodiment of this invention.

On a 1,500 denier polyester core yarn was inwardly coiled a copper wire (width: 0.34 mm, thickness: 0.07 mm, pitch: 0.7 mm) to form an inside electrode 2. This was followed by tubing with a thermosensitive polymer capacitor layer 3 (polyamide-phenol hybrid composition, thickness: 0.26 mm), outward coiling thereon of a copper wire (0.38 mm width and 0.08 mm thickness, at a pitch of 1.3 mm) to form an outside electrode 4, and coating with a polymer barrier layer 5 consisting of 11 nylon to constitute a flexible thermosensitive wire. This wire was used as a thermosensitive heating wire by utilizing the outerward copper wire as a heating element in an electric blanket. This thermosensitive heating wire has three functions:

(1) thermosensing, (2) heating and (3) action as a temperature fuse.

This flexible thermosensitive heating wire was immersed in a petroleum hydrocarbon dry cleaning solvent ("Disol" manufactured by Daikyo Oil Co., Ltd.) for 24 hours, followed by air drying for 24 hours and further drying at 80° C. for an additional 24 hours. The thermosensitive heating wire showed the same characteristics as before immersion in the solvent.

On the other hand, the heater temperature was raised from 150° C. at a rate of 1° C./min. to determine the fusing temperature of the temperature fuse. The fuse went out (fused) when the heater temperature reached about 60° C.

EXAMPLE 4

Figure 3:
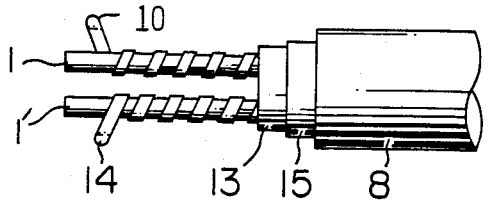
FIG. 3 is a side view of a second embodiment of flexible thermosensitive wire according to the present invention, the wire being shown partly cut away stepwise.

FIG. 3 illustrates a flexible thermosensitive wire having a different structure from the first-described embodiment and is a second embodiment according to this invention.

On two flexible core yarns 1, 1' of 1,500-denier polyester were formed inwardly coiled electrodes 10, 14 (copper wire, 0.43 mm wide and 0.07 mm thick, coiled at a pitch of 0.73 mm) so that said coiled electrodes 10, 14 run parallel to each other. Electrodes 10, 14 were covered with a thermosensitive polymer composition layer 13 which functions as a PTC resistance layer 13 composed of an ethylene-vinyl acetate copolymer containing 19% of carbon black. The structure was further tubed with polyvinyl fluoride to a thickness of 0.15 mm to form a barrier layer 15 and the tubing was coated with a polymer blend of ethylene-vinyl acetate copolymer and PVC to a thickness of 0.5 mm to form an outer jacket 8. The thus obtained flexible thermosensitive wire was subjected to a heat treatment, then immersed in perchloroethylene, an example of a dry cleaning solvent, for 3 hours, followed by air drying for 24 hours and further drying at 80° C. for 16 hours. The resistance-temperature characteristic before and after immersion in perchloroethylene was examined. As seen from FIG. 4 which shows The results of examination, a conventional wire having no barrier layer suffered an approximately 20 times change in resistance and did not restore the original resistivity (curve Y), whereas the flexible thermosensitive wire according to the present embodiment of this invention showed only a small change of resistance (curves $X_1$ and $X_2$).

Figure 4:
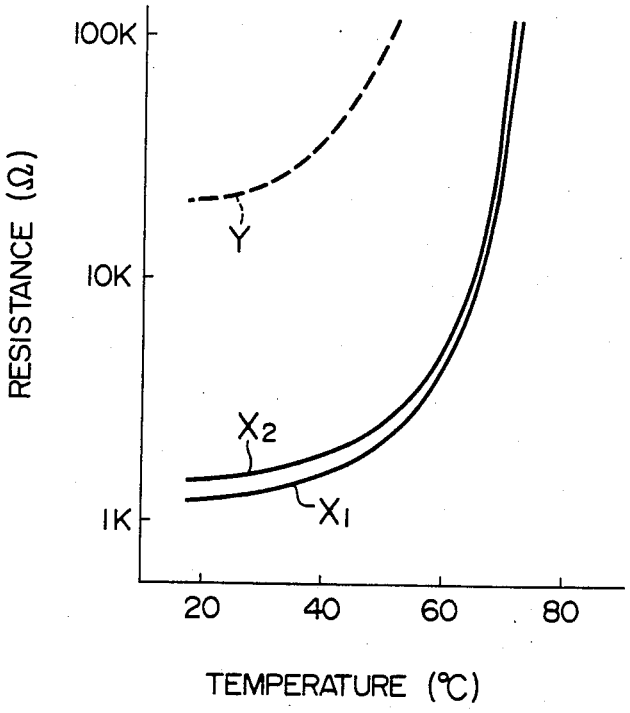
FIG. 4 is an impedance-temperature characteristic curve of the flexible thermosensitive wire of FIG. 3 and a conventional flexible thermosensitive wire.

Shown in FIG. 4 are the characteristic curves of resistivity for a 1 meter wire length, wherein Y is the characteristic curve of a conventional product after immersion, and X1 and X2 are the characteristic curves of the wire of Example 4 according to this invention before immersion (X1) and after immersion (X2).

The fact was thus verified that the incorporation of a barrier layer in the wire structure as in the described embodiments of this invention has the effect of protecting the inside against any influence by dry cleaning solvent, such as petroleum and halogenated hydrocarbons.

EFFECT OF THE INVENTION

As described above, the flexible thermosensitive wire according to this invention suffers no change in its properties during dry cleaning, which makes it possible to dry-clean electric heating fabrics, such as electric blankets, using same. Thus, by use of the wire according to this invention, there can be provided an electric heating fabric which can be used always in a clean state, safely and comfortably. The polymeric barrier layer in the present invention can be formed either as a layer covering the thermosensitive polymeric composition layer as in the above-described embodiments of the invention or as an outermost surface layer covering the electric insulating jacket, and in the latter case, the whole wire structure covered by such barrier layer can be protected against cleaning solvent.

The present invention contributes greatly to the industries concerned in that it enables dry cleaning of electric heating fabrics.

What is claimed is:

1. A flexible thermosensitive wire, comprising a thermosensitive polymer composition layer formed between at least a pair of electrodes and covered with a jacket, said jacket being comprised of a plurality of layers including at least one barrier layer, said at least one barrier layer consisting essentially of a barrier polymer material which is impermeable to dry cleaning solvents so that said at least one barrier layer protects said thermosensitive polymer composition layer by functioning as a barrier to dry cleaning solvents.

2. The flexible thermosensitive wire according to claim 1, wherein the polymer material of the barrier layer is at least one polymer selected from the group consisting of a vinyl alcohol copolymer, an acrylonitrile copolymer, a polyamide, a highly crystalline polyolefin, a fluorine-containing polymer, and a metal chelate-containing polymer.

3. The flexible thermosensitive wire according to claim 1, wherein said jacket comprises an inner layer and an outer layer, and wherein at least one of the inner layer and the outer layer is said at least one barrier layer.

4. The flexible thermosensitive wire according to claim 3, wherein the inner layer and the outer layer of the jacket are composed of different types of polymer materials.

5. The flexible thermosensitive wire according to claim 4, wherein the inner layer of the jacket is a barrier layer and is composed of the barrier polymer material, and the outer layer of the jacket is composed of an elastomer composition which is flexible and insoluble in dry cleaning solvents.

6. The flexible thermosensitive wire according to claim 5, wherein the elastomer composition is a polyvinyl chloride copolymer or a polyvinyl chloride polymer blend.

7. The flexible thermosensitive wire according to claim 1, wherein the at least a pair of electrodes is a pair of electrodes and consists of a first electrode and a second electrode positioned in parallel to one another, and wherein the thermosensitive polymer composition layer is provided on the first electrode, and the second electrode and the jacket are provided on said thermosensitive polymer composition layer in the order recited.

8. The flexible thermosensitive wire according to claim 1, wherein said thermosensitive polymer composition layer is a polymer thermistor layer composed of a polymer capacitor material and at least one of the electrodes functions as a heating wire.

9. The flexible thermosensitive wire according to claim 1, wherein the at least a pair of electrodes consists of a first electrode and a second electrode positioned in parallel to one another, and, wherein the thermosensitive polymer composition layer and the jacket are provided thereon in the order recited.

10. A flexible thermosensitive wire, comprising:

an elongate core of flexible yarn;

an inside electrode which is coiled around said elongate core of flexible yarn;

a thermosensitive layer comprised of a thermosensitive polymer composition and provided on said inside electrode;

an outside electrode which is coiled around said thermosensitive layer; and at least one barrier layer consisting essentially of a barrier polymer material provided concentrically on said outside electrode, said polymer material being impermeable to dry cleaning solvents so that said at least one barrier layer protects said thermosensitive layer by functioning as a barrier to said dry cleaning solvents.

11. A flexible thermosensitive wire, comprising:

a pair of elongate cores of flexible yarn disposed parallel to one another;

first and second electrodes coiled, respectively, around said pair of elongate cores of flexible yarn;

a thermosensitive layer comprised of a thermosensitive polymer composition and provided on and between said electrodes so as to hold said electrodes in a spaced apart relationship to one another; and at least one barrier layer consisting essentially of a barrier polymer material provided concentrically on said thermosensitive layer, said polymer material being impermeable to dry cleaning solvents so that said at least one barrier layer protects said thermosensitive layer by functioning as a barrier to said dry cleaning solvents.

* * * * *